US011600940B2

(12) United States Patent
Ando et al.

(10) Patent No.: US 11,600,940 B2
(45) Date of Patent: Mar. 7, 2023

(54) CONNECTOR WITH BUILT-IN SUBSTRATE AND METHOD OF MANUFACTURING CHAIN TERMINAL OF THE CONNECTOR WITH BUILT-IN SUBSTRATE

(71) Applicant: Yazaki Corporation, Tokyo (JP)

(72) Inventors: Ryota Ando, Shizuoka (JP); Hinata Hayashi, Shizuoka (JP); Masashi Tsukamoto, Shizuoka (JP); Nobuhiko Suzuki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/406,234

(22) Filed: Aug. 19, 2021

(65) Prior Publication Data

US 2022/0059961 A1 Feb. 24, 2022

(30) Foreign Application Priority Data

Aug. 21, 2020 (JP) ..... JP2020-139817

(51) Int. Cl.

| | |
|---|---|
| ***H01R 13/40*** | (2006.01) |
| ***H01R 13/405*** | (2006.01) |
| ***H01R 13/66*** | (2006.01) |
| ***H01R 12/55*** | (2011.01) |
| ***H01R 13/502*** | (2006.01) |
| ***H01R 43/24*** | (2006.01) |

(52) U.S. Cl.

CPC ..... *H01R 13/405* (2013.01); *H01R 12/55* (2013.01); *H01R 13/502* (2013.01); *H01R 13/66* (2013.01); *H01R 43/24* (2013.01)

(58) Field of Classification Search

CPC .... H01R 13/405; H01R 12/55; H01R 13/502; H01R 13/66; H01R 43/24; H01R 13/41; H01R 13/506; H01R 43/20; H01R 13/447; H01R 12/58; H01R 13/02; H01R 13/40; H01R 43/16

See application file for complete search history.

(56) References Cited

U.S. PATENT DOCUMENTS

| | | | | |
|---|---|---|---|---|
| 6,132,265 | A * | 10/2000 | Shih | H01M 50/50 439/500 |
| 6,699,067 | B1 * | 3/2004 | Zhao | H01R 12/7088 439/516 |
| 10,333,129 | B2 * | 6/2019 | Zhao | H01M 50/581 |
| 2018/0175530 | A1 * | 6/2018 | Fukui | H01R 12/727 |

(Continued)

FOREIGN PATENT DOCUMENTS

| | | | |
|---|---|---|---|
| JP | 2004-185958 | A | 7/2004 |
| JP | 2006-006052 | A | 1/2006 |

(Continued)

*Primary Examiner* — Truc T Nguyen

(74) *Attorney, Agent, or Firm* — Sughrue Mion, PLLC

(57) ABSTRACT

A connector with a built-in substrate includes a chain terminal including a chain portion, a first tab portion configured to protrude from the chain portion in a predetermined direction, a second tab portion configured to protrude from the chain portion in a direction different from a protrusion direction of the first tab portion; an inner housing in which the chain terminal is installed such that the first tab portion and the second tab portion protrude; and a substrate connected to the second tab portion protruding from the inner housing.

3 Claims, 8 Drawing Sheets

(56) References Cited

U.S. PATENT DOCUMENTS

| | | | | |
|---|---|---|---|---|
| 2019/0109417 | A1 | 4/2019 | Tsukamoto et al. | |
| 2020/0136291 | A1* | 4/2020 | Zhao | H01R 13/405 |
| 2020/0185870 | A1* | 6/2020 | Hamada | H01R 13/04 |
| 2020/0212642 | A1* | 7/2020 | Zhao | H01R 43/16 |
| 2022/0285316 | A1* | 9/2022 | Yuan | H01L 21/50 |

FOREIGN PATENT DOCUMENTS

| | | | |
|---|---|---|---|
| JP | 2010-231895 | A | 10/2010 |
| JP | 2019-067734 | A | 4/2019 |

* cited by examiner

CONNECTOR WITH BUILT-IN SUBSTRATE AND METHOD OF MANUFACTURING CHAIN TERMINAL OF THE CONNECTOR WITH BUILT-IN SUBSTRATE

CROSS REFERENCE TO RELATED APPLICATION

The present application is based on, and claims priority from the prior Japanese Patent Application No. 2020-139817 filed on Aug. 21, 2020, the entire contents of which are incorporated herein by reference.

TECHNICAL FIELD

The present application relates to a connector with a built-in substrate and a method of manufacturing a chain terminal of the connector with a built-in substrate.

BACKGROUND

A connector may be wrapped around and fixed to a wire harness. In this case, a connector with a built-in substrate may be required to fit in the same size and shape as a connector without a built-in substrate.

JP 2010-231895 A discloses a connector with a built-in substrate including a plurality of square wire rods bent in an L shape, a housing for holding the square wire rods, and a substrate installed at parts of the square wire rods protruding from the housing.

SUMMARY

However, in the connector with a built-in substrate disclosed in JP 2010-231895 A, since all of the plurality of terminals are connected to a substrate, an area for connecting the terminals to the substrate is required. That is, since it is necessary to connect all of the plurality of terminals to the substrate at a predetermined interval (at a predetermined pitch), it is necessary to increase a size of the substrate when viewed in the thickness direction.

An object of the present application is to provide a connector with a built-in substrate capable of reducing a size of the substrate and fitting an outer shape in a practical size and shape, and a method of manufacturing a chain terminal of the connector with a built-in substrate.

A connector with a built-in substrate comprises a chain terminal including a chain portion, a first tab portion configured to protrude from the chain portion in a predetermined direction, a second tab portion configured to protrude from the chain portion in a direction different from a protrusion direction of the first tab portion; a housing in which the chain terminal is installed such that the first tab portion and the second tab portion protrude; and a substrate connected to the second tab portion protruding from the housing.

Further, the connector with a built-in substrate may be configured such that the chain terminal is installed in the housing by engaging the chain portion with the housing.

Further, the connector with a built-in substrate may be configured such that the chain portion of the chain terminal is elongated in one predetermined direction, the chain terminal includes one or a plurality of the first tab portions, and the first tab portion protrudes toward a first side which is one side of the chain portion in the other predetermined direction orthogonal to a longitudinal direction of the chain portion, the chain terminal includes one or a plurality of the second tab portions, and the second tab portion protrudes toward a second side which is the other side of the chain portion in the other predetermined direction, and positions of at least some of the first tab portions and positions of at least some of the second tab portions are different from each other in the one predetermined direction.

Further, a method of manufacturing a chain terminal of the connector with a built-in substrate comprising a chain terminal including a chain portion, a first tab portion configured to protrude from the chain portion in a predetermined direction, a second tab portion configured to protrude from the chain portion in a direction different from a protrusion direction of the first tab portion, a housing in which the chain terminal is installed such that the first tab portion and the second tab portion protrude, and a substrate connected to the second tab portion protruding from the housing, comprises an intermediate molded-object molding step of molding an intermediate molded object provided with an elongated chain portion forming section configured to form the chain portion, the plurality of first tab portions configured to protrude from the chain portion forming section and the plurality of second tab portions configured to protrude from the chain portion forming section by hollowing out an elongated flat plate-like material having a predetermined thickness and a predetermined width in a thickness direction of the material; and a chain terminal molding step of molding the chain terminal by cutting or notching at least a part of the chain portion forming section of the intermediate molded object formed in the intermediate molded-object molding step.

The above configuration makes it possible to provide a connector with a built-in substrate capable of reducing a size of the substrate and fitting an outer shape in a practical size and shape, and a method of manufacturing a chain terminal of the connector with a built-in substrate.

DETAILED DESCRIPTION

Figure 11:
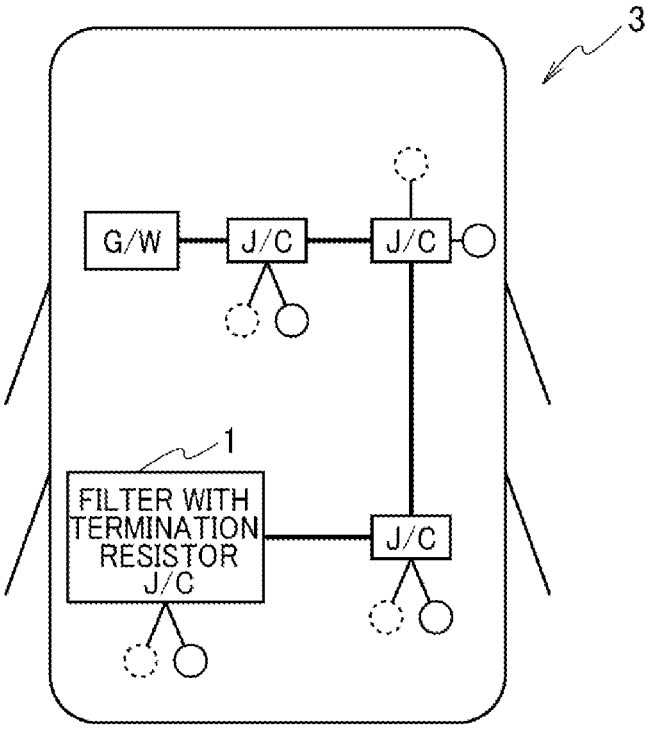
FIG. 11 is a diagram showing an embodiment of use of the connector with a built-in substrate according to the present embodiment.
Figure 12:
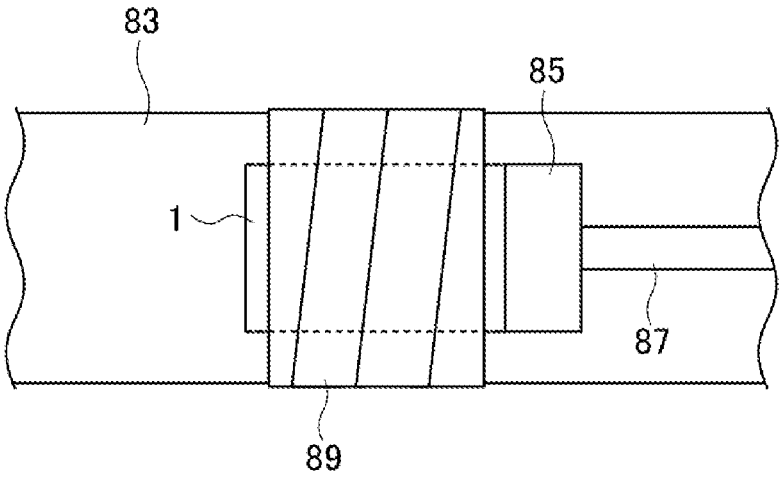
FIG. 12 is a diagram showing an embodiment of use of the connector with a built-in substrate according to the present embodiment.

A connector with a built-in substrate 1 according to the present embodiment is connected to a mating connector 85 and used, for example, in an on-vehicle network (CAN: Controller Area network) 3 as a filter with a termination resistor. The on-vehicle network 3 is shown in FIG. 11, and the mating connector 85 is shown in FIG. 12. As shown in FIGS. 1 to 9C, the connector with a built-in substrate 1 includes a chain terminal (connection terminal) 5, a housing (for example, inner housing) 7, and a substrate (circuit substrate) 9. The connector with a built-in substrate 1 may be referred to as an electric component connected to a mating connector.

Here, for convenience of explanation, a predetermined direction in the connector with a built-in substrate 1 is defined as a vertical direction, a predetermined position direction orthogonal to the vertical direction is defined as a horizontal direction, and a direction orthogonal to the vertical direction and the horizontal direction is defined as a front-rear direction.

The chain terminal 5 is made of a conductive material such as metal, and includes a chain portion (connection portion: middle portion) 11, a first tab portion 13, and a second tab portion 15. The first tab portion 13 protrudes from the chain portion 11 in a predetermined direction (for example, a front side in the front-rear direction). The second tab portion 15 protrudes from the chain portion 11 in a direction different from the protrusion direction of the first tab portion 13 (for example, a rear side in the front-rear direction).

A position where the first tab portion 13 protrudes from the chain portion 11 and a position where the second tab portion 15 protrudes from the chain portion 11 are different from each other. That is, a position of a base end of the first tab portion 13 (boundary between the chain portion 11 and the first tab portion 13) and a position of a base end of the second tab portion 15 (boundary between the chain portion 11 and the second tab portion 15) are different from each other, for example, in the horizontal direction.

The inner housing 7 is integrally molded with an insulating material such as synthetic resin. The chain terminal 5 is integrally installed in the inner housing 7 such that the first tab portion 13 and the second tab portion 15 protrude from a thick portion of the inner housing 7 to an outside of the inner housing 7 (for example, in the front-rear direction).

The substrate 9 is connected, for example, by soldering, to the second tab portion 15 protruding from a wall part of the inner housing 7. The substrate 9 is installed in the chain terminal 5 after the chain terminal 5 is installed in the inner housing 7.

The connector with a built-in substrate 1 is provided with an outer housing 17, a cover 19, and a ferrite 23. In the outer housing 17, the cover 19, the ferrite 23 and an inner housing assembly 21 (see FIG. 8C) are integrally provided. The inner housing assembly 21 is the inner housing 7 in which the substrate 9 and the chain terminal 5 are installed. The outer housing 17 is integrally molded with an insulating material such as synthetic resin, and the cover 19 is also integrally molded with an insulating material such as synthetic resin.

More specifically, the ferrite 23 is integrally installed in the inner housing assembly 21. The inner housing assembly 21 in which the ferrite 23 is installed and the cover 19 are installed in the outer housing 17, thereby obtaining the connector with a built-in substrate 1.

In the connector with a built-in substrate 1, the first tab portion 13 can be seen from an opening (a first opening positioned on the front side) 25 of the outer housing 17. As described above, a terminal of the mating connector 85 (for example, a female terminal of a female connector) is connected to the first tab portion 15 (see FIG. 12).

In the connector with a built-in substrate 1, the substrate 9 and a part 29 slightly protruding to the rear side from the substrate 9 of the second tab portion 15 are configured to be seen from another opening (a second opening positioned on the rear side) 27 of the outer housing 17. The cover 19 is installed integrally in the outer housing 17 so as to close the second opening 27. Since the cover 19 closes the second opening 27 of the outer housing 17, the substrate 9 and the second tab 15 portion of the connector with a built-in substrate 1 are configured not to be seen from the outside of the connector with a built-in substrate 1.

The chain terminal 5 is integrally installed in the inner housing 7 by engaging (for example, press-fitted) only the chain portion 11 with the inner housing 7. The chain terminal 5 may be disposed in the inner housing 7 such that the chain portion 11 and the tab portions 13 and 15 near the chain portion 11 are engaged with the inner housing 7.

The chain portion 11 of the chain terminal 5 is elongated in one predetermined direction (for example, a horizontal direction). The chain terminal 5 includes one or a plurality of the first tab portions 13. The first tab portion 13 protrudes from the chain portion 11 toward a first side (for example, a front side) which is one side of the chain portion 11 in the other predetermined direction (for example, a front-rear direction) orthogonal to a longitudinal direction of the chain portion 11.

In the case where a plurality of first tab portions 13 are provided, each of the plurality of first tab portions 13 protrudes from the chain portion 11 in parallel and apart from each other. The protrusion lengths of the plurality of first tab portions 13 are equal to each other, for example.

The chain terminal 5 includes one or a plurality of the second tab portions 15. The second tab portion 15 protrudes from the chain portion 11 toward a second side (for example, a rear side) which is the other side of the chain portion 11 in the other predetermined direction (for example, a front-rear direction) orthogonal to a longitudinal direction of the chain portion 11.

Even in the case where a plurality of second tab portions 15 are provided, each of the plurality of second tab portions 15 protrudes from the chain portion 11 in parallel and apart from each other. The protruding lengths of the plurality of second tab portions 15 are equal to each other, for example.

Figure 1:
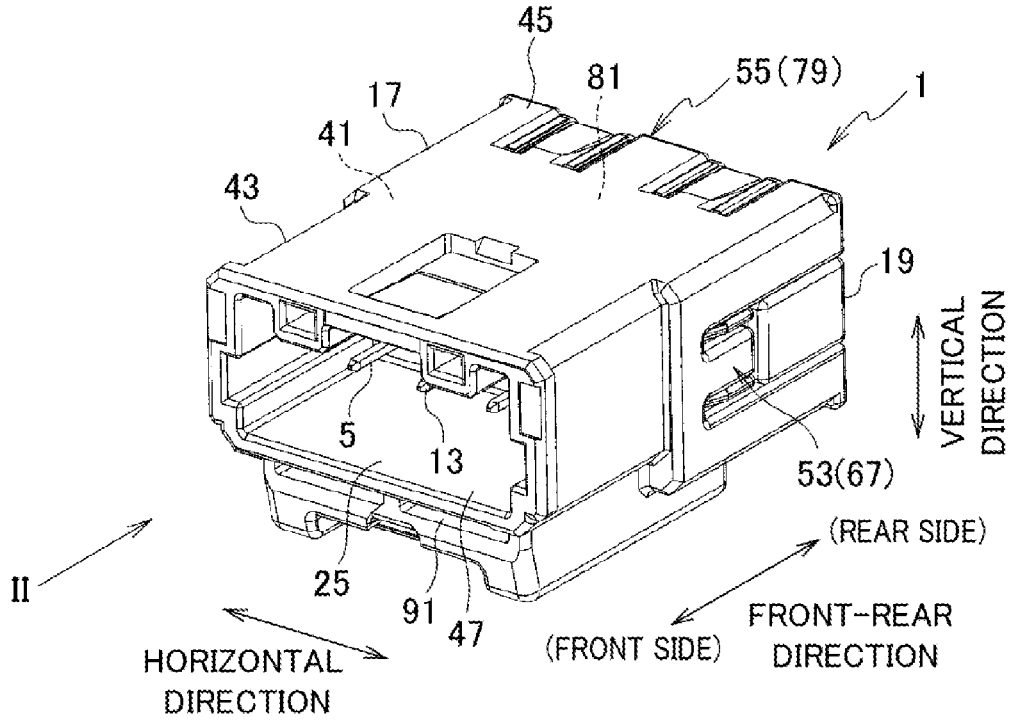
FIG. 1 is a perspective view of a connector with a built-in substrate according to the present embodiment.
Figure 2:
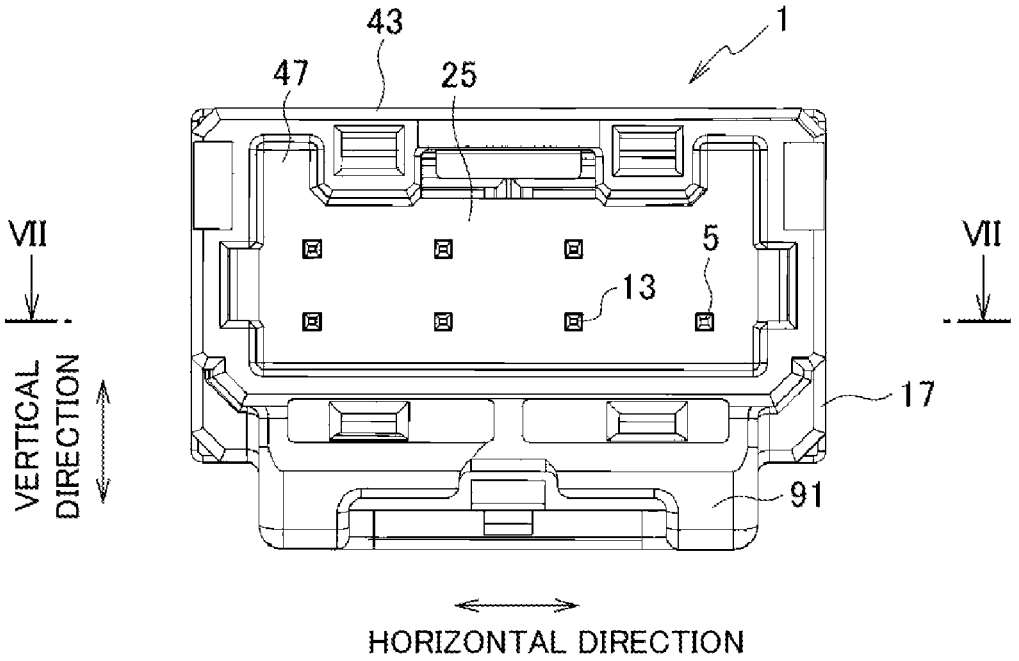
FIG. 2 is an arrow-II view in FIG. 1.
Figure 3:
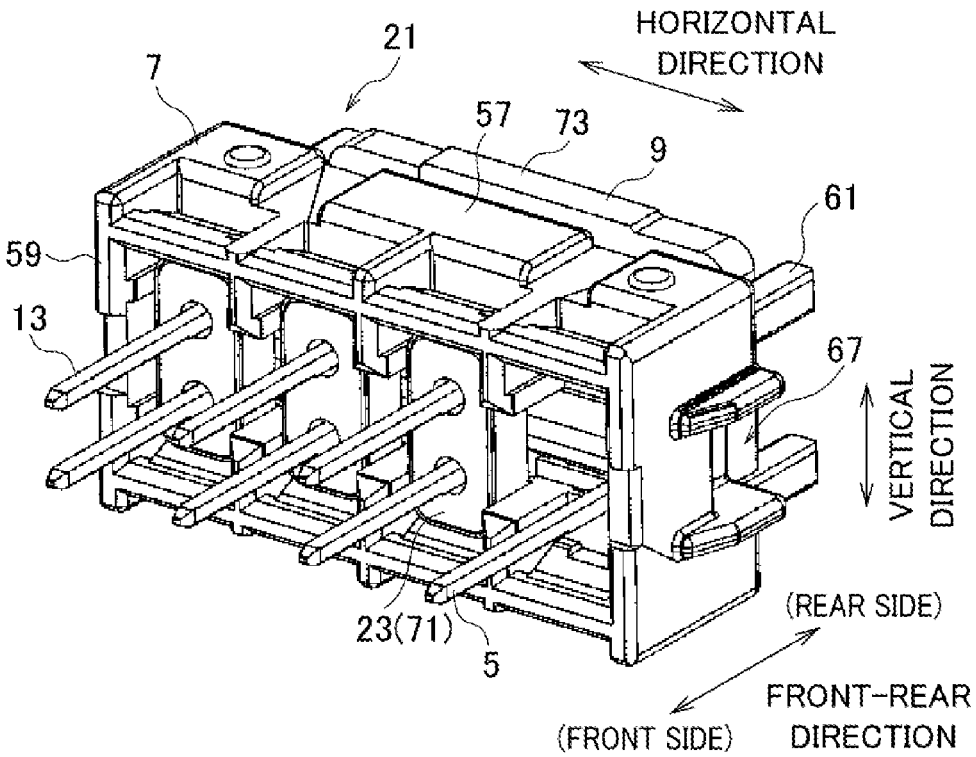
FIG. 3 is a diagram showing a state in which an outer housing and a cover are removed from the connector with a built-in substrate shown in FIG. 1.
Figure 4:
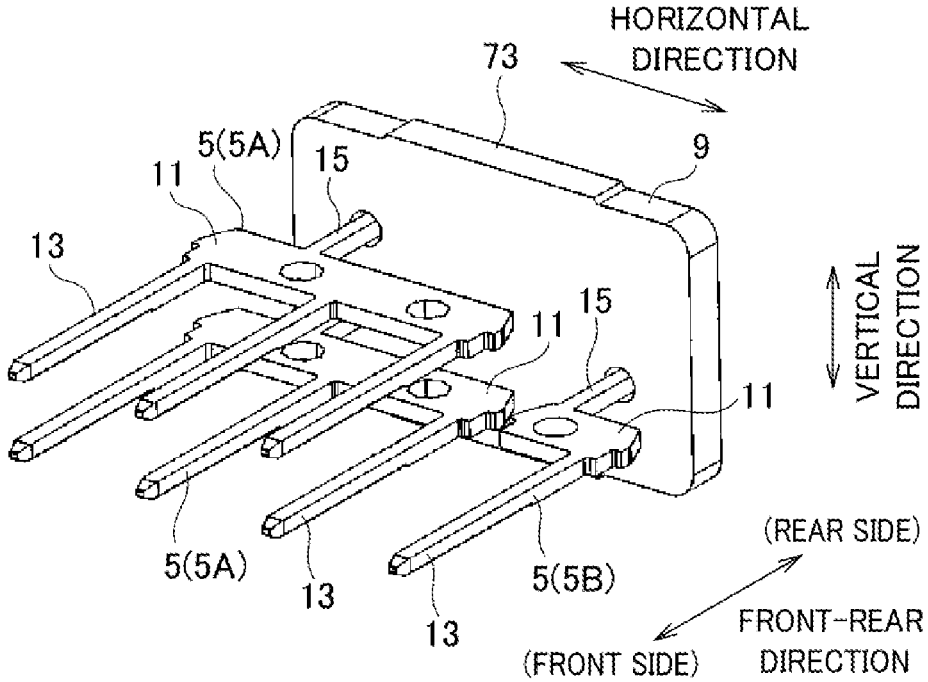
FIG. 4 is a perspective view showing a state in which the outer housing, the cover, and an inner housing are removed from the connector with a built-in substrate shown in FIG. 1, and showing chain terminals, a substrate.

When the chain terminal 5 is viewed in the other predetermined direction (for example, a front-rear direction) which is a protrusion direction of the tab portions 13 and 15, the positions of at least some of the first tab portions 13 and the positions of at least some of the second tab portions 15 are different from each other. As shown in FIG. 4, for example, all of the plurality of first tab portions 13 and all of the plurality of the second tab portions 15 are at positions different from each other in one predetermined direction (e.g., a horizontal direction) which is a longitudinal direction of the chain portion 11. That is, when viewed in the front-rear direction, none of the plurality of first tab portions 13 overlap with any of the plurality of second tab portions 15.

The single connector with a built-in substrate 1 includes, for example, the plurality of chain terminals 5, one inner housing 7, one substrate 9, one outer housing 17, and one cover 19. The shapes of the plurality of chain terminals 5 may be different from each other or may be identical to each other. Further, the some shapes of the plurality of chain terminals 5 may be identical to each other.

A method of manufacturing the chain terminal 5 of the connector with a built-in substrate 1 will now be described with reference to FIG. 10. The chain terminal 5 is manufactured through an intermediate molded-object molding step and a chain terminal molding step.

In the intermediate molded-object molding step, an elongated flat plate-like material 31 having a predetermined thickness and a predetermined width is hollowed out (for example, punched) in the thickness direction to mold an intermediate molded object 33. In FIG. 10, the material 31 and any other elements are viewed in the thickness direction.

The intermediate molded object 33 is provided with an elongated chain portion forming section 35 forming the chain portion 11, the plurality of first tab portions 13 protruding from the chain portion forming section 35, and the plurality of second tab portions 15 protruding from the chain portion forming section 35. The first tab portions 13 and the second tab portions 15 are formed in an elongated square columnar shape. That is, these are formed in the shape of a square wire rod.

In the chain terminal molding step, at least a part of the chain portion forming section 35 of the intermediate molded object 33, which is formed in the intermediate molded-object molding step, is cut or notched. By cutting or notching in this way, the chain portion forming section 35 is divided into the plurality of chain portions 11 in the longitudinal direction, thereby obtaining the plurality of chain terminals 5.

More specifically, the material 31 is formed in an elongated rectangular shape that extends long with a predetermined width dimension when viewed in the thickness direction. The width direction of the material 31 corresponds to the front-rear direction of the connector with a built-in substrate 1, the longitudinal direction of the material 31 corresponds to the horizontal direction of the connector with a built-in substrate 1, and the thickness direction of the material 31 corresponds to the vertical direction of the connector with a built-in substrate 1.

When the intermediate molded object 33 is viewed in the thickness direction of the material 31, the chain portion forming section 35 is formed in a rectangular shape which is longer and thinner than the material 31 (a value of the width dimension is smaller), and extends long in the longitudinal direction of the material 31 at a middle portion in the width direction of the material 31.

When the intermediate molded object 33 is viewed in the thickness direction of the material 31, the first tab portion 13 is thinner than the chain portion forming section 35. When the intermediate molded object 33 is viewed in the thickness direction of the material 31, the first tab portion 13 protrudes from a first end (front-side end) which is one end in the width direction of the chain portion forming section 35 to one side (front side) in the width direction of the material 31. When the intermediate molded object 33 is viewed in the thickness direction of the material 31, a leading end of the first tab portion 13 is coincident with or positioned near a first end (front end) in the width direction of the material 31. The plurality of first tab portions 13 are provided. When the intermediate molded object 33 is viewed in the thickness direction of the material 31, the plurality of first tab portions 13 are arranged at a constant interval in the longitudinal direction of the material 31 (chain portion forming section 35).

When the intermediate molded object 33 is viewed in the thickness direction of the material 31, the second tab portion 15 of the intermediate molded object 33 is thinner than the chain portion forming section 35 in the same manner as the first tab portion 13. When the intermediate molded object 33 is viewed in the thickness direction of the material 31, the second tab portion 15 protrudes from a second end (rear-side end) which is the other end in the width direction of the chain portion forming section 35 to the other side (rear side) in the width direction of the material 31. When the intermediate molded object 33 is viewed in the thickness direction of the material 31, a leading end of the second tab portion 15 is coincident with or positioned near a second end (rear end) in the width direction of the material 31. The plurality of second tab portions 15 are provided. When the intermediate molded object 33 is viewed in the thickness direction of the material 31, the plurality of second tab portions 15 are arranged at the same constant interval as the first tab portions 13 in the longitudinal direction of the material 31 (chain portion forming section 35).

The protrusion length of the first tab portion 13 from the chain portion forming section 35 is larger than the protrusion length of the second tab portion 15 from the chain portion forming section 35. When the intermediate molded object 33 is viewed in the thickness direction of the material 31, the respective positions of the plurality of first tab portions 13 and the respective positions of the plurality of second tab portions 15 are different from each other in the longitudinal direction of the material 31. More specifically, in the longitudinal direction of the chain portion forming section 35 (the material 31), the second tab portion 15 is positioned at the center of the two first tab portions 13 adjacent to each other. In other words, in the longitudinal direction of the chain portion forming section 35, the first tab portion 13 is positioned at the center of the two second tab portions 15 adjacent to each other.

In the chain terminal molding step, for example, the chain portion forming section 35 is cut such that the three first tab portions 13 adjacent to each other and the two second tab portions 15 positioned between the three first tab portions 13 protrude from the chain portion 11. Thereafter, in the chain terminal molding step, one of the two second tab portions 15 is removed (see hatched portion 39 in FIG. 10). Thus, the chain terminal 5A shown in FIG. 10 is obtained.

Figure 10:
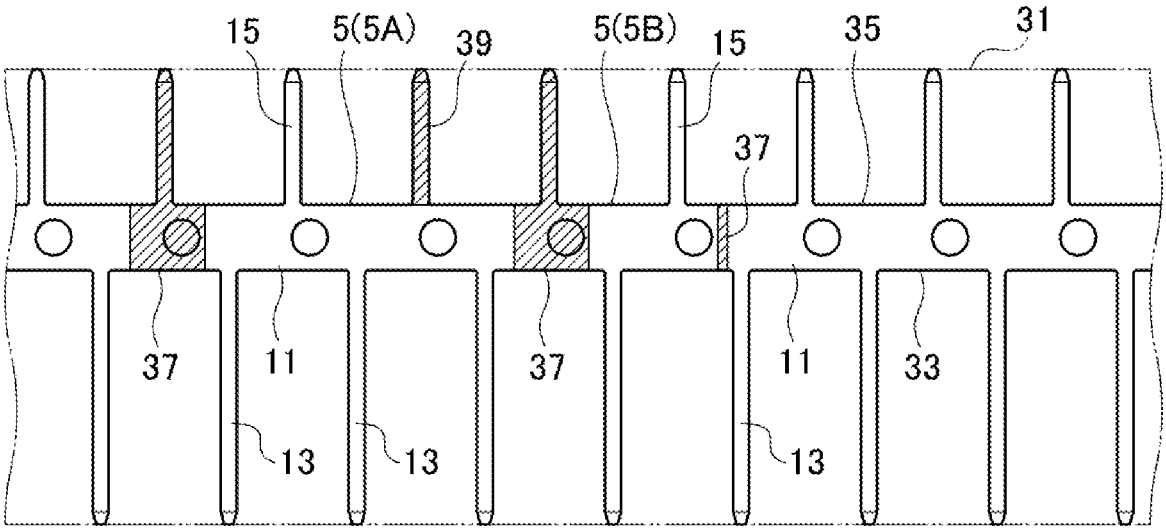
FIG. 10 is a diagram showing a manufacturing process of the chain terminals of the connector with a built-in substrate according to the present embodiment.

Further, in the chain terminal molding step, for example, the chain portion forming section 35 is cut such that one of the first tab portions 13 adjacent to each other and one second tab portion 15 adjacent to the one first tab portion 13 protrude from the chain portion 11 (see hatched portion 37 in FIG. 10). Thus, the chain terminal 5B shown in FIG. 10 is obtained.

The connector with a built-in substrate 1 will now be described in more detail.

The outer housing 17 includes an outer housing body 41, a first cylindrical portion 43 and a second cylindrical portion 45. The first cylindrical portion 43 is formed in a rectangular cylindrical shape, and the second cylindrical portion 45 is also formed in a rectangular cylindrical shape, and a central axis of the first cylindrical portion 43 and a central axis of the second cylindrical portion 45 coincide with each other and extend in the front-rear direction. The first cylindrical portion 43 protrudes to the front side from the outer housing body 41, and the second cylindrical portion 45 protrudes to the rear side from the outer housing body 41.

The outer housing body 41 is formed in a flat plate shape, for example, and is positioned between the first cylindrical portion 43 and the second cylindrical portion 45 in the front-rear direction, and separates a space inside the first cylindrical portion 43 from a space inside the second cylindrical portion 45.

The outer housing 17 is provided with an inner housing installation portion 51, an inner housing locking portion 53 and a cover locking portion 55. The outer housing body 41 is provided with a through hole through which the first tab portion 13 of the chain terminal 5 penetrates.

The inner housing 7 includes a bottom wall portion 57 and a side wall portion 59 and is formed in a generally rectangular pit shape. The side wall portion 59 protrudes to the front side from the bottom wall portion 57. The inner housing 7 further includes a protrusion 61. The protrusion 61 protrudes to the rear side from the bottom wall portion 57 at both ends in the horizontal direction, for example.

The bottom wall portion 57 is provided with a through hole 63 penetrating through a thick portion of the bottom wall portion 57 in the front-rear direction, and a front portion of the through hole 63 is a chain portion press-fitting section 69 into which the chain portion 11 of the chain terminal 5 is press-fitted. The second tab portion 15 of the chain terminal 5 penetrates through the rear side portion of the through hole 63. A ferrite installation portion 71 in which a ferrite 23 provided with a through hole 65 is installed is provided on the front side portion of the chain portion press-fitting section 69 into which the chain portion 11 of the chain terminal 5 is press-fitted.

The inner housing 7 is provided with a locked portion 67, and when the inner housing 7 is installed in the outer housing 17, the locked portion 67 is locked to the inner housing locking portion 53. The inner housing 7 is prevented from coming off from the outer housing 17.

In a state where the chain terminal 5 and the ferrite 23 are installed in the inner housing 7, the chain portion 11 is press-fitted into the chain portion press-fitting section 69. In the above state, the first tab portion 13 protrudes to the front side from the inner housing 7, and the second tab portion 15 protrudes to the rear side from the inner housing 7. Further, in the above state, the first tab portion 13 penetrates through the through hole 65 of the ferrite 23, and the first tab portion 13 also protrudes to the front side from the ferrite 23.

Figure 5:
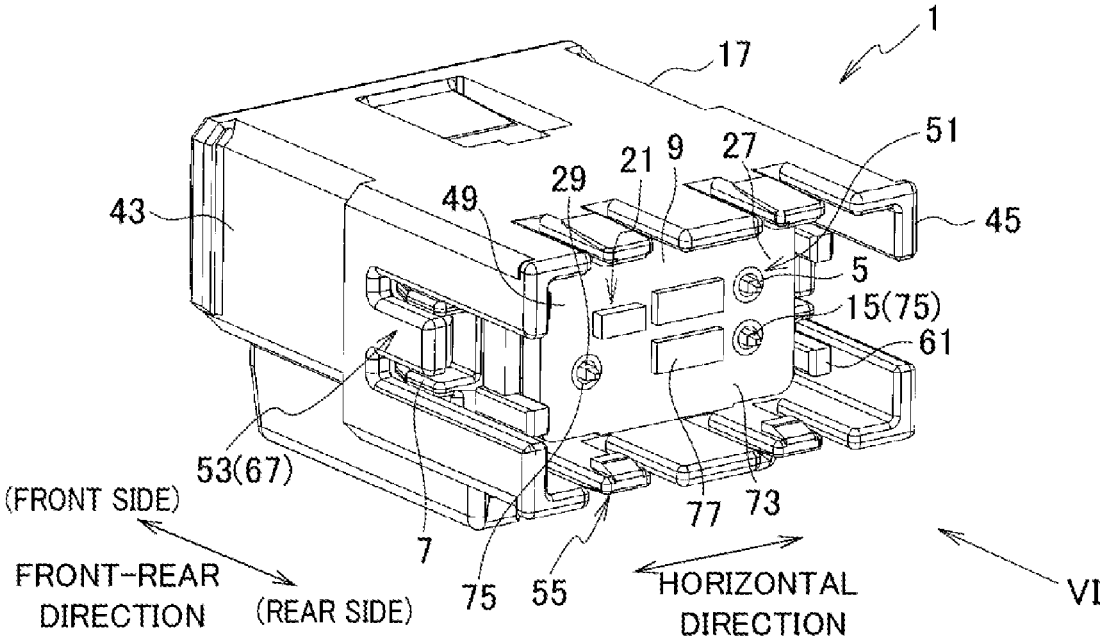
FIG. 5 is a perspective view of the connector with a built-in substrate according to the present embodiment viewed from a direction different from FIG. 1, and the view showing a state in which the cover is removed.
Figure 6:
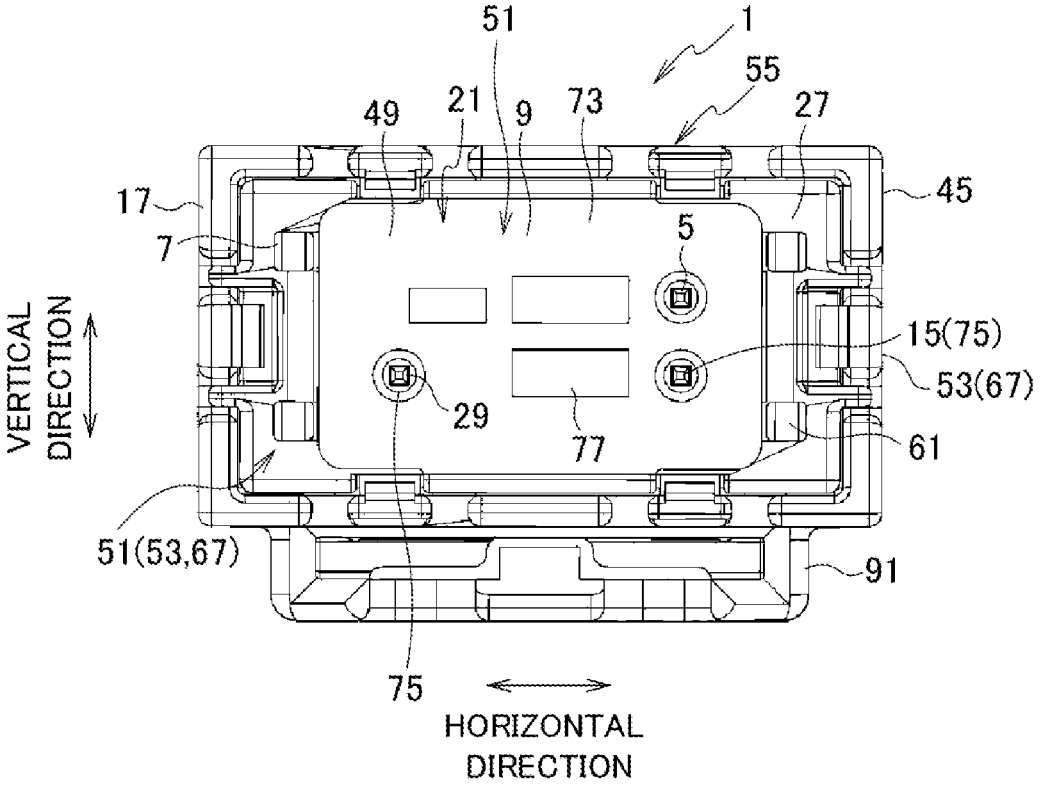
FIG. 6 is an arrow-VI view in FIG. 5.
Figure 7:
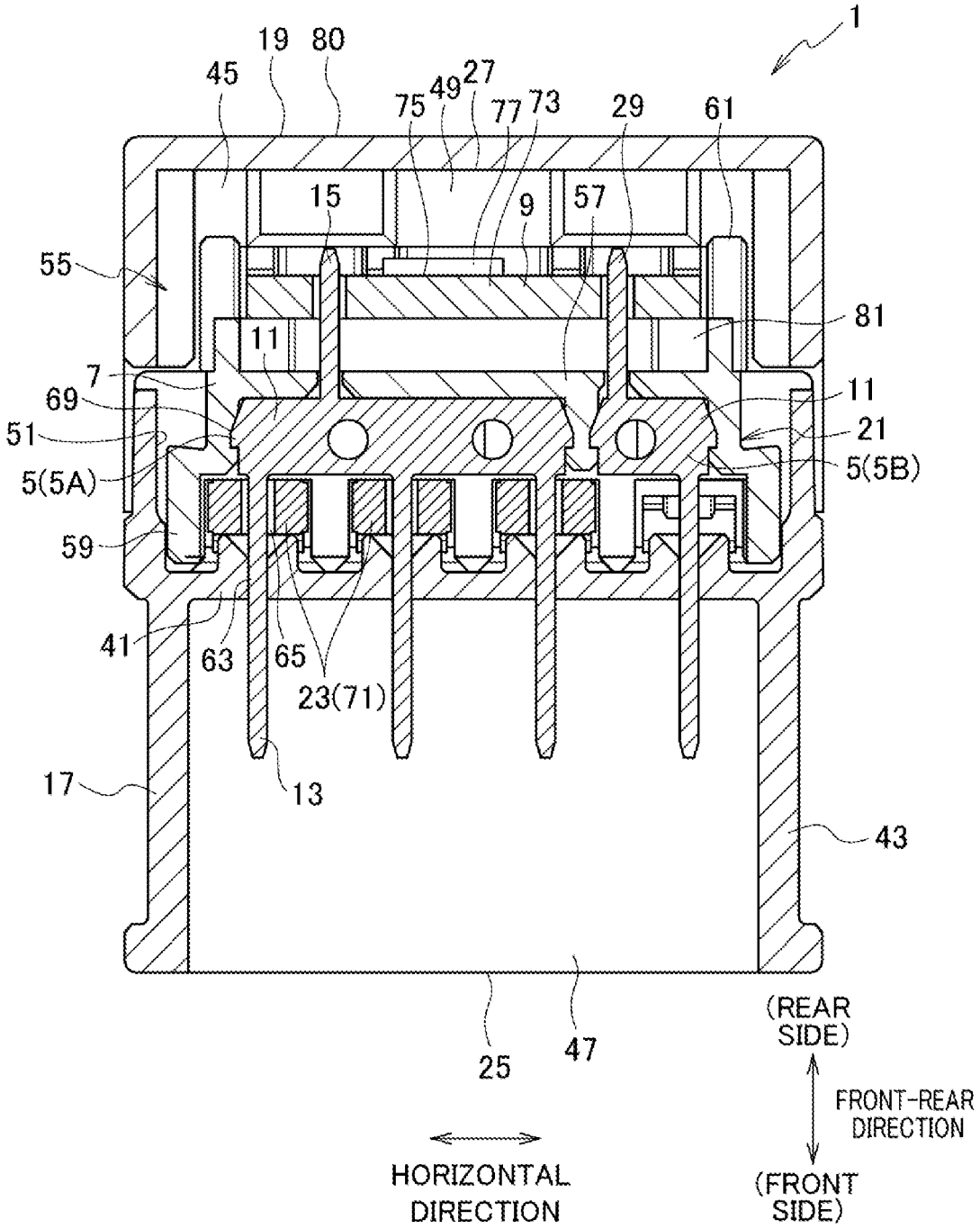
FIG. 7 is a sectional view taken along a line VII-VII in FIG. 2.

The substrate 9 includes a rectangular plate-shaped substrate body 73, a circuit pattern 75, and an electronic component 77. Further, since a part of the circuit pattern 75 is connected to a leading end portion (rear end portion) of the second tab portion 15 of the chain terminal 5, the substrate 9 is installed in the chain terminal 5. Further, as shown in FIGS. 5 and 6, since the part 29 of the second tab portion 15 of the chain terminal 5 only slightly protrudes to the rear side from the substrate 9, it is easy to secure a space for installing the electronic component 77 on the rear side surface (rear surface) of the substrate 9.

Further, in the front-rear direction, the leading end (rear end) of the second tab portion 15 of the chain terminal 5 may be positioned at the same position as a plane surface of the rear end of the substrate body 73, or may be positioned on the front side of the plane surface of the rear end of the substrate body 73. The plane surface of the rear end of the substrate body 73 is one surface of the substrate body 73 in the thickness direction and faces the rear side.

The cover 19 includes a cover body 80 for closing an opening of the second cylindrical portion 45, and a locked portion 79 locked to the cover locking portion 55 of the outer housing 17. When the cover 19 is installed in the outer housing 17, the locked portion 79 is locked to the cover locking portion 55 to prevent the cover 19 from coming off from the outer housing 17.

As already understood, the substrate 9 is integrally installed in the inner housing 7 via the chain terminals 5.

More specifically, the outer housing 17, the inner housing 7, and the cover 19 form a closed space 81. The second tab portion 15 of the chain terminal 5 protrudes from the closed space 81. The protruding second tab portion 15 is separated from the outer housing 17 and the cover 19. The substrate 9 is joined to the second tab portion 15 and is separated from the outer housing 17 and the cover 19. Thus, even if a force is applied to an outer surface of the connector with a built-in substrate 1, the force does not reach the substrate 9.

In the connector with a built-in substrate 1, the outer housing 17 and the inner housing 7 are directly joined and integrated with each other, and the inner housing 7 and the chain terminal 5 are directly joined and integrated with each other. Further, in the connector with a built-in substrate 1, the chain terminal 5 and the substrate 9 are directly joined and integrated with each other.

Next, an assembling procedure of the connector with a built-in substrate 1 will be described with reference to FIGS. 8A to C and FIGS. 9A to C.

Figure 8A:
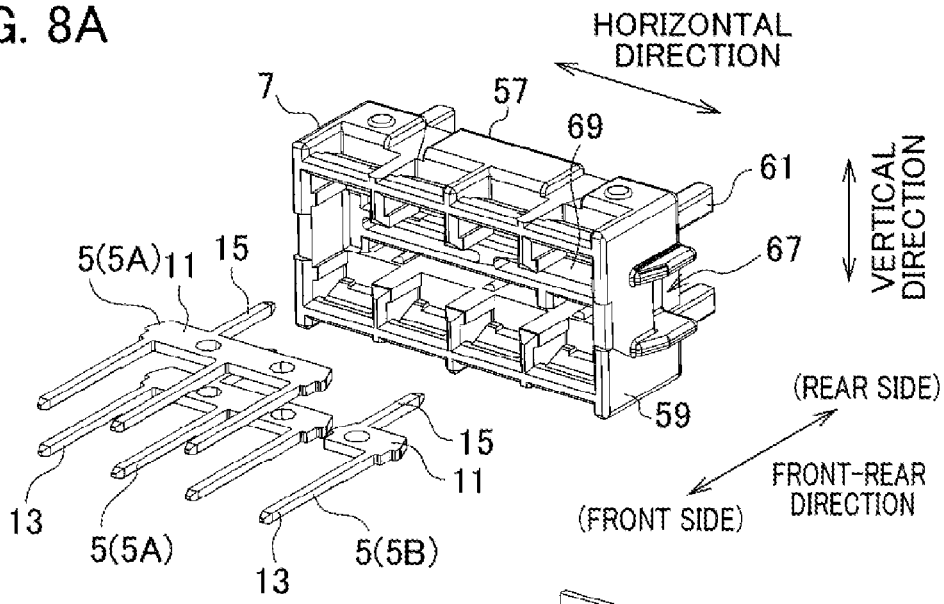
FIGS. 8A, 8B, and 8C are diagrams showing an assembling procedure of the connector with a built-in substrate according to the present embodiment.
Figure 8B:
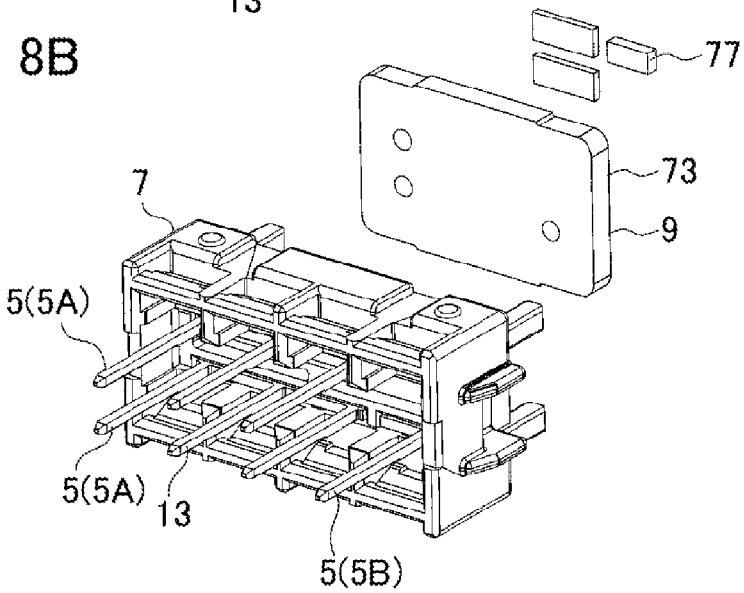
Figure 8C:
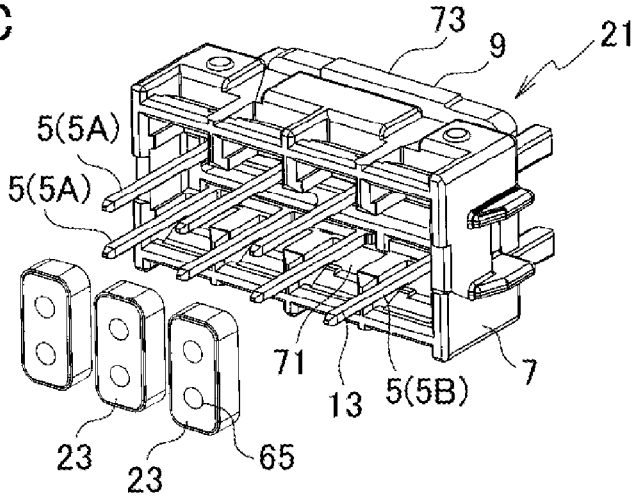

First, as shown in FIG. 8A, the chain terminal 5 is installed in the inner housing 7. The chain terminal 5 is installed by moving the chain terminal 5 to the rear side with respect to the inner housing 7. Subsequently, as shown in FIG. 8B, the substrate 9 is installed in the chain terminal 5. The substrate 9 is installed by moving the substrate 9 to the front side with respect to the chain terminal 5. Subsequently, as shown in FIG. 8C, the ferrite 23 is installed in the inner housing 7 (inner housing assembly 21). The ferrite 23 is installed by moving the ferrite 23 to the rear side with respect to the inner housing assembly 21.

Figure 9A:
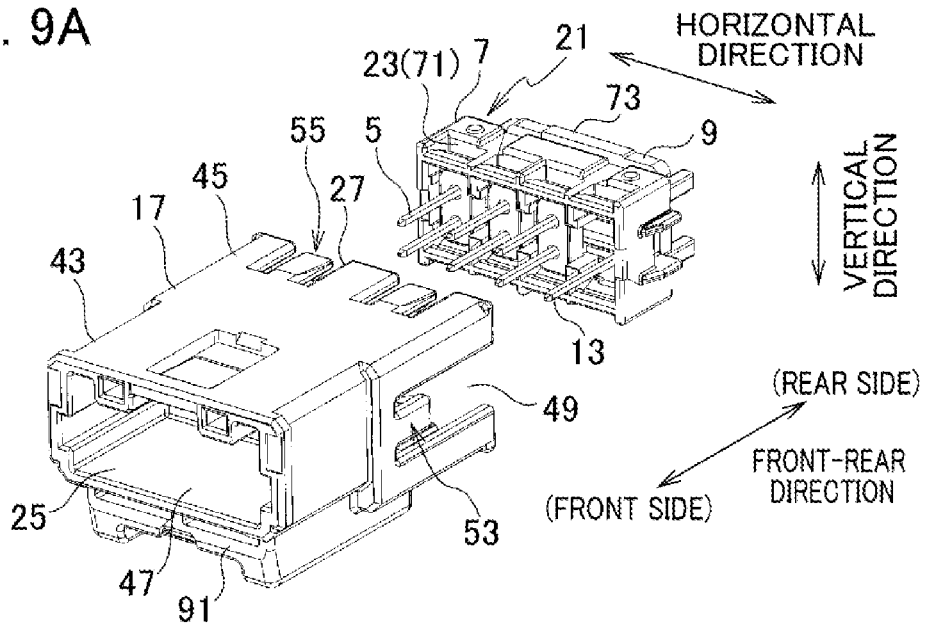
FIGS. 9A, 9B, and 9C are diagrams showing an assembling procedure of the connector with a built-in substrate according to the present embodiment.
Figure 9B:
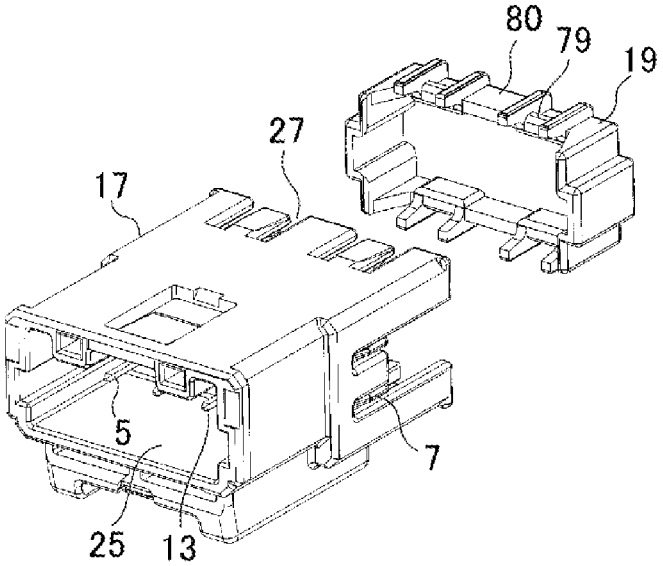
Figure 9C:
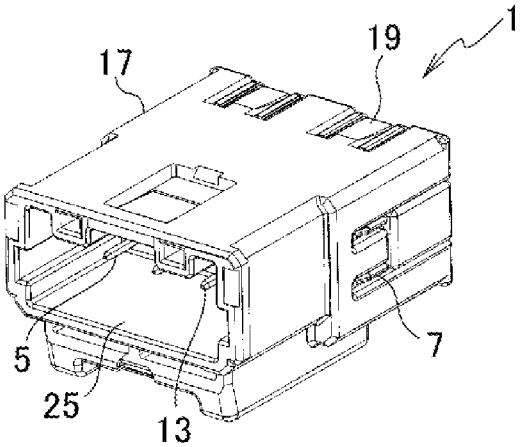

Subsequently, as shown in FIG. 9A, the inner housing 7 (inner housing assembly 21 and ferrite 23) is installed in the outer housing 17. The inner housing assembly 21 is installed by moving the inner housing assembly 21 to the front side with respect to the outer housing 17. Subsequently, as shown in FIG. 9B, the cover 19 is installed in the outer housing 17. Thus, as shown in FIG. 9C, the connector with a built-in substrate 1 is obtained. The cover 19 is installed by moving the cover 19 to the front side with respect to the outer housing 17.

Next, an installation of the connector with a built-in substrate 1 to a wire harness 83 will be described with reference to FIG. 12.

First, the mating connector 85 is installed in the connector with a built-in substrate 1. Wiring 87 such as an electric wire extends from the mating connector 85. Subsequently, the connector with a built-in substrate 1 is installed in a member to be installed such as the wire harness 83 by using a connector installation body with a built-in substrate such as a tape 89. The connector with a built-in substrate 1 is installed in the wire harness 83, for example, by winding the tape 89 around the wire harness 83 and the connector with a built-in substrate 1 in contact with the wire harness 83.

The outer housing 17 of the connector with a built-in substrate 1 is provided with an outer housing installation portion 91, for example, formed in an annular shape (rectangular cylindrical shape). A string-like installation member (not shown) is passed through the annular outer housing installation portion 91, and this installation member is bound or wound to the wire harness 83. In this way, the connector with a built-in substrate 1 may also be installed in the wire harness 83.

The connector with a built-in substrate 1 includes the chain terminal 5, the inner housing 7 and the substrate 9. The chain terminal 5 includes the chain portion 11, the first tab portion 13 protruding from the chain portion 11, and the second tab portion 15 protruding from the chain portion 11 in a direction different from the first tab portion 13. The chain terminal 5 is installed in the inner housing 7 such that the first tab portion 13 and the second tab portion 15 protrude. The substrate 9 is connected to the second tab portion 15 protruding from the inner housing 7.

With this configuration, the size of the substrate 9 can be reduced. By reducing the size of the substrate 9, an outer shape of the connector with a built-in substrate 1 can be fitted in a practical size and shape.

That is, since the chain terminal 5 is provided with the chain portion 11, a circuit joint function of the substrate 9 is provided to the chain portion 11 of the chain terminal 5 by using the chain terminal 5 as a connection terminal. Thus, the terminal (second tab portion 15) can be connected to any position of the substrate 9. That is, a size of the substrate 9 can be reduced by freely setting a position of the second tab portion 15 with respect to the substrate 9 and the first tab portion 13.

Further, since the number of connections between the chain terminal 5 (second tab portion 15) and the substrate 9 can be minimized, a pitch between substrate lands can be easily secured. Further, compatibility with the general-purpose female connector (mating connector) 85 connected to the first tab portion 13 can be ensured. That is, it is possible to secure connection with the general-purpose mating connector 85. Further, after press-fitting the chain terminal 5 into the inner housing 7, it is not necessary to perform additional bending of the terminal.

Next, a comparative example will be described. A connector with a built-in substrate according to a comparative example includes a plurality of square wire rods bent in an L shape, a housing for housing the square wire rods, and a substrate installed in portions of the square wire rods protruding from the housing.

The connector with a built-in substrate according to the comparative example includes an outer housing, an inner housing, a terminal, and a substrate. A metal square wire formed in an elongated square columnar shape is used in the terminal. A plurality of terminals are provided, and each terminal is installed in the inner housing by press-fitting, for example. A first end, which is one end of the terminal, protrudes from a first end face which is one end face of the inner housing. Further, a second end, which is the other end of the terminal, protrudes from a second end face which is the other end face of the inner housing The substrate is installed at the second end of the terminal. The inner housing in which the terminal and the substrate are installed is installed in the outer housing. The outer housing is provided with two cylindrical portions. The first end of the terminal protruding from the inner housing is disposed in the first cylindrical portion which is one of the two cylindrical portions. The second end of the terminal protruding from the inner housing and the substrate are disposed in the second cylindrical portion which is the other one of the two cylindrical portions.

However, in the connector with a built-in substrate according to the comparative example, since all the terminals are connected to the substrate, an area for connecting the terminals to the substrate is required. That is, since it is necessary to connect all of the plurality of terminals to the substrate at a predetermined interval (at a predetermined pitch), it is necessary to enlarge the substrate when viewed in a thickness direction.

A general-purpose product is generally used as a mating connector connected to a connector with a built-in substrate, which makes it difficult to reduce an area of the substrate by changing a pitch between respective terminals.

In the connector with a built-in substrate 1 according to the present embodiment, the chain portion 11 of the chain terminal 5 is press-fitted into the inner housing 7, so that the chain terminal 5 is installed in the inner housing 7. With this structure, when the chain terminal 5 is press-fitted into the inner housing 7, it is only necessary that a load has to be applied to the chain portion 11, thereby preventing the chain terminal 5 (in particular, tab portions 13 and 15) from being deformed due to a press-fit load.

In the connector with a built-in substrate 1 viewed in the front-rear direction, the positions of at least some of the first tab portions 13 and the positions of at least some of the second tab portions 15 are different from each other. As a result, the position of the second tab portion 13 relative to the position of the first tab portion 15 is arbitrarily changed, thereby making it possible to realize the above-mentioned miniaturization of the substrate 9 and the use of the mating connector 85 as a general-purpose product.

Further, the chain terminal 5 of the connector with a built-in substrate 1 is manufactured through the intermediate molded-object molding step and the chain terminal molding step. In the intermediate molded-object molding step, the elongated flat plate-like material 31 is punched to mold the intermediate molded object 33 including the chain portion forming section 35, the plurality of first tab portions 13 and the plurality of second tab portions 15. In the chain terminal molding step, the chain terminal 5 is obtained by cutting a part of the chain portion forming section 35 of the intermediate molded object 33, thereby improving a manufacturing efficiency of the chain terminal 5.

Figure 13:
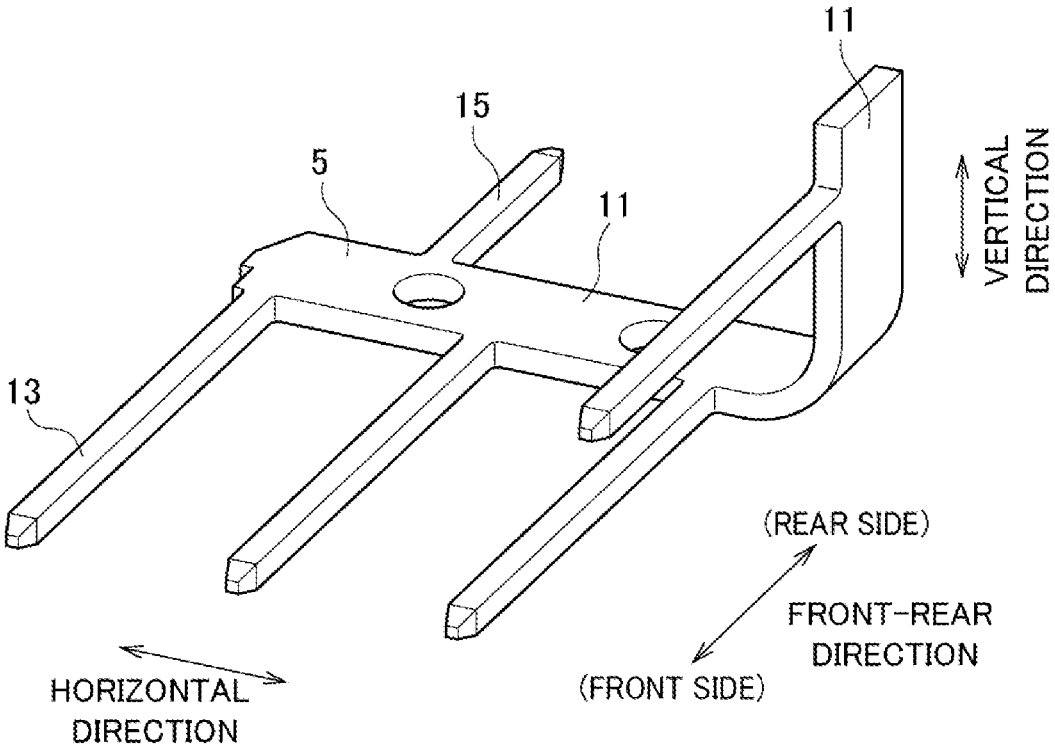
FIG. 13 is a perspective view of a chain terminal (chain terminal according to a modification example) of the connector with a built-in substrate according to the present embodiment.

In the above description, the chain terminal 5 is formed into a flat plate predetermined shape (a predetermined shape when viewed in the thickness direction) by punching the flat plate material 31. That is, the chain terminal 5 is formed in a two-dimensional shape. On the other hand, as shown in FIG. 13, the chain terminal 5 may be formed in a three-dimensional shape, for example, by bending the chain portion 11 of the chain terminal 5. Even in this modification example, all of the plurality of first tab portions 13 and all of the second tab portions 15 are at positions different from each other in the horizontal direction. That is, when viewed in the front-rear direction, none of the plurality of first tab portions 13 overlap with any of the plurality of second tab portions 15.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A connector with a built-in substrate comprising:

a chain terminal including a chain portion, a first tab portion configured to protrude from the chain portion in a predetermined direction, a second tab portion configured to protrude from the chain portion in a direction different from a protrusion direction of the first tab portion;

a housing in which the chain terminal is installed such that the first tab portion and the second tab portion protrude; and a substrate connected to the second tab portion protruding from the housing, wherein the chain portion of the chain terminal is elongated in one predetermined direction, the chain terminal includes one or a plurality of the first tab portions, and the first tab portion protrudes toward a first side which is one side of the chain portion in the other predetermined direction orthogonal to a longitudinal direction of the chain portion, the chain terminal includes one or a plurality of the second tab portions, and the second tab portion protrudes toward a second side which is the other side of the chain portion in the other predetermined direction, and positions of at least some of the first tab portions and positions of at least some of the second tab portions are different from each other in the one predetermined direction.

2. The connector with a built-in substrate according to claim 1, wherein the chain terminal is installed in the housing by engaging the chain portion with the housing.

3. A method of manufacturing a chain terminal of a connector with a built-in substrate, wherein the connector with the built-in substrate comprises:

a chain terminal including a chain portion, a first tab portion configured to protrude from the chain portion in a predetermined direction, a second tab portion configured to protrude from the chain portion in a direction different from a protrusion direction of the first tab portion;

a housing in which the chain terminal is installed such that the first tab portion and the second tab portion protrude; and a substrate connected to the second tab portion protruding from the housing, the method comprising:

an intermediate molded-object molding step of molding an intermediate molded object provided with an elongated chain portion forming section configured to form the chain portion, the plurality of first tab portions configured to protrude from the chain portion forming section and the plurality of second tab portions configured to protrude from the chain portion forming section by hollowing out an elongated flat plate-like material having a predetermined thickness and a predetermined width in a thickness direction of the material; and a chain terminal molding step of molding the chain terminal by cutting or notching at least a part of the chain portion forming section of the intermediate molded object formed in the intermediate molded-object molding step.

* * * * *